US011344877B2

(12) United States Patent
Vulto et al.

(10) Patent No.: US 11,344,877 B2
(45) Date of Patent: May 31, 2022

(54) CAPILLARY PRESSURE BARRIERS

(71) Applicant: UNIVERSITEIT LEIDEN, Leiden (NL)

(72) Inventors: Paul Vulto, Leiden (NL); Sebastiaan Johannes Trietsch, Leiden (NL); Ender Yildirim, Leiden (NL)

(73) Assignee: UNIVERSITEIT LEIDEN, Leiden (NL)

( * ) Notice: Subject to any disclaimer, the term of this patent is extended or adjusted under 35 U.S.C. 154(b) by 0 days.

(21) Appl. No.: 14/426,920

(22) PCT Filed: Sep. 10, 2013

(86) PCT No.: PCT/NL2013/050650
§ 371 (c)(1),
(2) Date: Mar. 9, 2015

(87) PCT Pub. No.: WO2014/038943
PCT Pub. Date: Mar. 13, 2014

(65) Prior Publication Data

US 2015/0238952 A1 Aug. 27, 2015

(30) Foreign Application Priority Data

Sep. 10, 2012 (GB) ..... 1216118
Aug. 7, 2013 (NL) ..... 2011280

(51) Int. Cl.
*B01L 3/00* (2006.01)

(52) U.S. Cl.
CPC ..... *B01L 3/00* (2013.01); *B01L 3/502738* (2013.01); *B01L 3/502746* (2013.01);
(Continued)

(58) Field of Classification Search
CPC ..... B01L 3/502738; B01L 3/502746; B01L 3/502784; B01L 3/502792;
(Continued)

(56) References Cited

U.S. PATENT DOCUMENTS 4,426,451 A 1/1984 Columbus
9,291,284 B2 * 3/2016 Penterman ..... B01L 3/502738
(Continued)

FOREIGN PATENT DOCUMENTS

CN 1715929 1/2006
CN 102387864 3/2012
(Continued)

OTHER PUBLICATIONS

Juncker et al. "Autonomous Microfluidic Capillary System" Anal. Chem. 74:6139-6144 (2002).
(Continued)

*Primary Examiner* — Brian R Gordon
(74) *Attorney, Agent, or Firm* — Nixon Peabody LLP; Ronald I. Eisenstein; Nicole D. Kling

(57) ABSTRACT

The present invention relates to an apparatus for controlling the shape and/or position of a moveable fluid-fluid meniscus, and methods of use, in particular a method to control the shape of a moveable fluid-fluid meniscus in an apparatus in which the meniscus is caused to align along a stable capillary barrier or phaseguide.

8 Claims, 11 Drawing Sheets

(52) U.S. Cl.
CPC . *B01L 3/502776* (2013.01); *B01L 2200/0636* (2013.01); *B01L 2200/0642* (2013.01); *B01L 2200/0647* (2013.01); *B01L 2300/0816* (2013.01); *B01L 2300/0851* (2013.01); *B01L 2300/0864* (2013.01); *B01L 2300/0867* (2013.01); *B01L 2300/161* (2013.01); *B01L 2400/0688* (2013.01); *B01L 2400/086* (2013.01); *B01L 2400/088* (2013.01)

(58) Field of Classification Search
CPC ..... B01L 2400/0688; B01L 2400/0694; B01L 2400/086; B01L 2300/161
See application file for complete search history.

(56) References Cited

U.S. PATENT DOCUMENTS

| | | | | |
|---|---|---|---|---|
| 2004/0241051 | A1 | 12/2004 | Wyzgol et al. | |
| 2006/0002817 | A1 | 1/2006 | Bohm et al. | |
| 2006/0264779 | A1* | 11/2006 | Kemp | A61B 5/1427 600/583 |
| 2013/0299015 | A1* | 11/2013 | Penterman | B01L 3/502738 137/544 |
| 2016/0160208 | A1* | 6/2016 | Santiago | C12N 15/101 204/451 |

FOREIGN PATENT DOCUMENTS

| | | | | |
|---|---|---|---|---|
| EP | 2213364 | | 8/2010 | |
| JP | 1982156028 | | 9/1982 | |
| JP | 2006055837 | | 3/2006 | |
| JP | 0003157523 | | 2/2010 | |
| JP | 2012516414 | | 7/2012 | |
| NL | WO 2012098214 | A1 * | 7/2012 | B01L 3/502738 |
| WO | 01/85602 | | 11/2001 | |
| WO | 03/072227 | | 9/2003 | |
| WO | 2006/061025 | | 6/2006 | |
| WO | 2007/110779 | A2 | 10/2007 | |
| WO | 2008/049638 | | 5/2008 | |
| WO | 2010/086179 | A2 | 8/2010 | |
| WO | 10/116341 | | 10/2010 | |
| WO | 2010/116341 | A1 | 10/2010 | |
| WO | 2012/120101 | | 9/2012 | |

OTHER PUBLICATIONS

Leu et al., "Pressure barrier of capillary stop valves in micro sample separators" Sensors and Actuators 115:508-515 (2004).
Vulto et al., "Phaseguides: a paradigm shift in microfluidic priming and emptying" Lab on a Chip, The Royal Society of Chemistry 11(9):1596 (2011).
Vulto et al., "A microfluidic approach for high efficiency extraction of low molecular weight RNA", Lab Chip 10 (5):610-616 (2010).
Vulto, "A Lab-on-a-Chip for automated RNA extraction from bacteria", Dissertation for University of Freiburg (2008).

* cited by examiner

CAPILLARY PRESSURE BARRIERS

CROSS-REFERENCES TO RELATED APPLICATIONS

This application is a 35 U.S.C. § 371 National Phase Entry Application of International Application No. PCT/NL13/050650 filed Sep. 10, 2013; which claims benefit of GB Application No. 1216118.8, filed Sep. 10, 2012; and NL Application No. 2011280, filed Aug. 7, 2013, the contents of which are incorporated herein by reference in their entireties.

FIELD OF THE INVENTION

The invention concerns improvements relating to capillary pressure barriers.

BACKGROUND OF THE INVENTION

There is growing scientific and industrial interest in stable capillary pressure barriers for controlling or influencing the behaviour of fluids, especially liquids or liquid-containing substances. Such stable capillary pressure barriers are of particular utility in the field of microfluidics, in which they are highly useful in controlling the flow of bodies of liquids in volumes the sizes and shapes of which are designed for specific purposes such as assaying, "aliquoting" (i.e. the dispensing to or from a volume of a predetermined quantity of a liquid), mixing, separating, confining metering, patterning and containing. Effective passively exerted fluid flow control has become greatly sought-after to controlling liquids in large microfluidic circuits and liquids in microfluidic chambers. Stable capillary pressure barriers are also used in a wide range of other applications.

BRIEF SUMMARY OF THE INVENTION

The invention potentially finds application in all situations in which stable capillary pressure barriers can be used. Capillary pressure barrier are also referred to as meniscus alignment barriers or pinning barriers in the art.

Some forms of stable capillary pressure barrier are designated as "phaseguides". This is primarily because of their function in defining a moveable meniscus. The location, shape, advancement or some other physical characteristic can be influenced by the combined effects of the design of the stable capillary pressure barrier and energy (typically fluid pressure) applied to a fluid that exists on one or other of the sides of the meniscus. The present invention relates to capillary pressure barriers when designated or referred to as phaseguides.

According to the invention in a broad aspect there is provided an apparatus for controlling the shape and/or position of a moveable fluid-fluid meniscus, the apparatus comprising a volume for containing and directing fluid, the filling direction being a downstream direction, including the meniscus and the volume having at least a first structure defining a capillary pressure barrier along which the meniscus tends to align, the capillary pressure barrier and the meniscus defining a boundary in the volume between at least two sub-volumes, wherein (a) the capillary pressure barrier is stabilized by subtending at both ends an angle with a wall of the volume that on the downstream side of the capillary pressure barrier is greater than 90°, while not having a location of deliberate weakness as provided by a sharp V-shaped bend or a branch along the capillary pressure barrier that reduces the stability of the capillary pressure barrier and/or (b) wherein the capillary pressure is stabilized by providing a stretching barrier at a distance less than the maximum stretching distance of the fluid-fluid meniscus upon alignment along the capillary pressure barrier in the absence of the stretching barrier, the stretching barrier being shaped such that at least one directional component is orthogonal to the capillary pressure barrier, and/or (c) the capillary pressure barrier is stabilized by subtending at one end an angle with a wall of the volume that on the downstream side of the capillary pressure barrier is greater than 90°, and at the other end is stabilized by providing a stretching barrier at a distance less than the maximum stretching distance of the fluid-fluid meniscus upon alignment along the capillary pressure barrier in the absence of the stretching barrier, the stretching barrier being shaped such that at least one directional component is orthogonal to the capillary pressure barrier.

An advantage of the invention is to provide a capillary pressure barrier, the stability of which is drastically improved by having it subtend at both ends a downstream angle with a wall that is larger than 90°, by providing a second barrier orthogonal to the capillary pressure barrier that prevents the meniscus from obtaining its stretched state that is energetically most advantageous for barrier overflow. The invention may suitably be employed for shaping of one or more liquid boundaries as well as guiding a multitude of liquid boundaries through a channel network. A number of geometries will be disclosed that enable a practical implementation of such stable capillary pressure barriers.

BRIEF DESCRIPTION OF THE DRAWINGS

There now follows a description of preferred embodiments of the invention, by way of non-limiting example, with reference being made to the accompanying drawings in which.

DETAILED DESCRIPTION OF THE INVENTION

The invention also resides in a method of controlling the shape of a moveable fluid-fluid meniscus in apparatus according to the invention as defined herein, the method comprising the step of causing the meniscus to align along the stable capillary pressure barrier of the apparatus.

Meniscus pinning in microfluidics is a well-known phenomenon used to create capillary stop structures and achieve meniscus alignment. Meniscus pinning occurs when energy has to be applied in order to advance the meniscus over its pinning position. Typically, a sharp ridge is used inside a channel or chamber to create a stable meniscus alignment feature that forces the meniscus to deform such that advancement of the meniscus becomes energetically disadvantageous. The meniscus then tends to align along the resulting capillary pressure barrier unless additional energy, in the form of e.g. an increase in fluid pressure, is applied. Unless specifically mentioned otherwise, meniscus pinning and meniscus alignment relate to the same state of the meniscus throughout this document.

The pressure drop ($\Delta P$) over a liquid-air interface is defined as the sum of its principal radii ($R_1$ and $R_2$):

$$\Delta P = \gamma\left(\frac{1}{R_1} + \frac{1}{R_2}\right) \quad \text{(I)}$$

with $\gamma$ the liquid-air surface tension and the radii $R_1$ and $R_2$ being functions of their contact angles.

Figure 1:
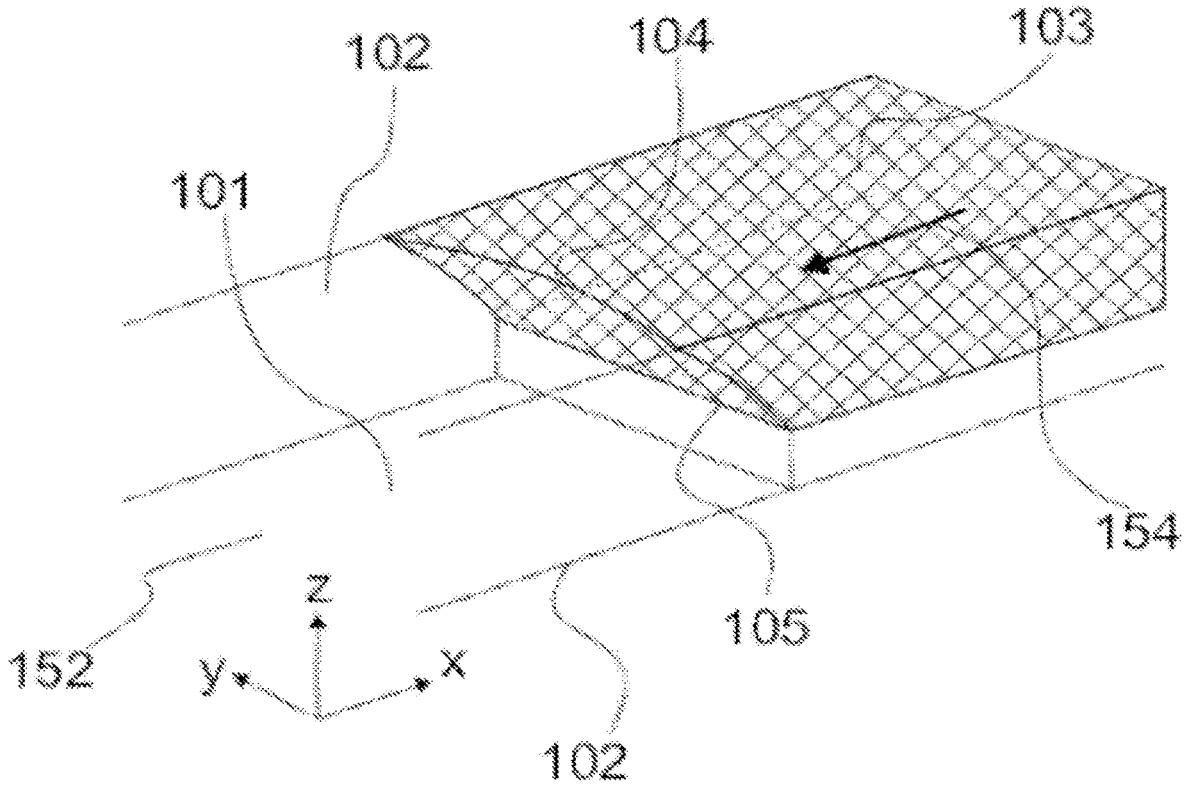
FIG. 1 is a perspective view of a pinned meniscus and a pinning structure.

FIG. 1 illustrates a capillary pressure barrier 105 that is based on a sharp edge that spans the complete length of the meniscus 104 of a fluid-fluid interface in the xy-plane in a volume 152 as defined graphically in FIG. 1. It is possible to understand its meniscus pinning behaviour by dissecting it in xy- and a xz-views.

Figure 2:
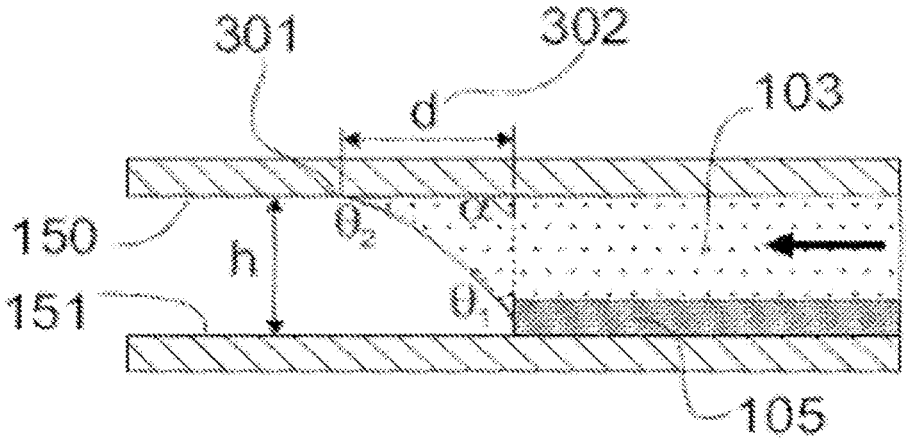
FIG. 2 is a vertically sectioned view, as described herein, of the FIG. 1 arrangement.

FIG. 2 shows meniscus advancement over the edge of the pinning structure 105 located on a bottom substrate 151. FIG. 2 depicts the fluid-fluid meniscus in the xz-direction, which is faced with a geometry that is similar to a wedge. The dotted line virtually indicates one side of the wedge while the second side is formed by the top substrate 150. The meniscus may give a positive or negative contribution to the pressure depending whether the sum of contact angles of the meniscus with top substrate 150 ($\theta_2$) and pinning barrier 105 ($\theta_1$) is by rough approximation larger (positive contribution) or smaller (negative contribution) than 180° minus the angle $\alpha$ of the wedge (for instance 90° for a protrusion sidewall that is orthogonal to the top-substrate). FIG. 2 in fact depicts the situation of a negative pressure contribution of the meniscus radius in xz-direction as can be judged from the convex meniscus shape of the pinned fluid 103. A configuration including both contact angles having a value of 70° and a pinning surface, beyond the edge of the meniscus pinning structure, that is perpendicular to the top substrate 107 results in a positive pressure contribution, while for both contact angles of 30° the pressure contribution would be negative.

It furthermore may be noticed in FIG. 2 that the position of the meniscus at the capillary pressure barrier is less advanced in x-direction than the position 301 of the meniscus-substrate section of the substrate that is facing the capillary pressure barrier (also referred to as counter-substrate or top substrate) 150. This asymmetry that occurs upon meniscus pinning is referred to as "stretching" of the meniscus. Depending on the contact angles and the geometry of the capillary pressure barrier, the stretched meniscus may have both a convex as well as a concave profile.

In FIG. 2 the stretching distance of the meniscus is shown as $d_s$ 302. Typically overflow of the capillary pressure barrier occurs only after the meniscus has taken a shape that is most energetically advantageous for overflow. This is typically the case when the meniscus is fully stretched as defined by its contact angles and geometry of the capillary pressure barrier.

Figure 3:
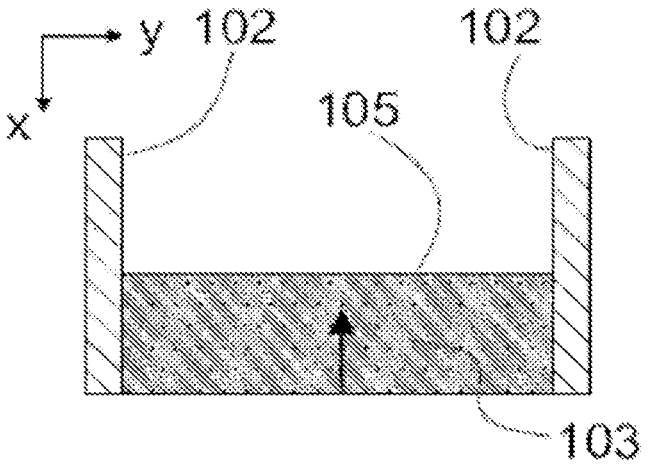
FIGS. 3 and 4 are horizontally sectioned views, as described herein, respectively illustrating the condition of the structure and meniscus in the conditions before and upon overflow.

FIG. 3 shows in section of the meniscus in the xy-direction (as defined) at the level just above the capillary pressure barrier. The shape is given in simplified form as a straight line that is aligned along the upper edge. In this configuration the xy-contribution to the meniscus pressure away from the side walls is zero. However in order for the meniscus to advance overflow of the ridge needs to occur, requiring deformation of the xy-profile.

Figure 4:
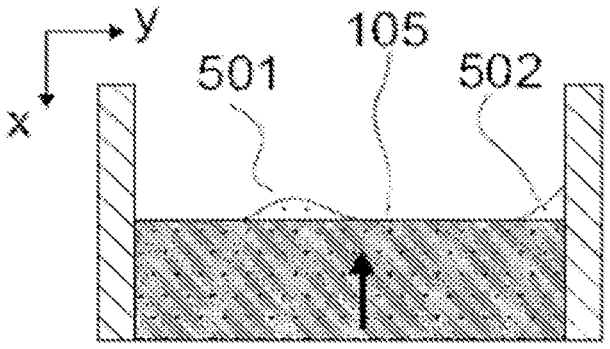

FIG. 4 shows different options for overflow. Meniscus overflow could either take place along the capillary pressure barrier away from the side walls 501, or at one of the two corners at the interface between the capillary pressure barrier and the sidewall 502. For a hydrophilic system it is energetically advantageous to advance at the position where the fluid wets most surface, i.e. at a wedge shape with smallest angle. This is in most cases the interface between the capillary pressure barrier and the side-wall.

For the avoidance of doubt, the two different types of overflow condition in FIG. 4 would not normally arise in one and the same meniscus. They are shown in combination in FIG. 4 purely in order to illustrate them economically.

The sharpness of the corner of the capillary pressure barrier-wall interface is also an important parameter. As an infinitely sharp corner does not exist, and on the contrary each corner has a radius. Without wishing to be bound to any particular theory, applicant's found that the larger this radius, the more stable the corner is.

The example disclosed in FIGS. 1 to 4 shows that the stability of a pinning structure can be tuned by the angles and the radius of the corner with the side walls. The example also shows that the actual xz-ridge geometry is of secondary importance to the pinning effect, as the xy-geometry can be most easily tuned in the design and thus used to determine the stability.

The example disclosed in FIGS. 1-4 also shows that the stability of a pinning structure increased by preventing the meniscus to reach its most energetically optimized shape for overflow of the capillary pressure barrier. This can be done by preventing the meniscus from stretching.

In fact, angle tuning and stretching prevention functions by the same principal also for hydrophobic capillary pressure barriers or capillary pressure barriers based on a less hydrophilic material in a largely more hydrophilic chamber structure.

The usage of angle variation to determine overflow control is disclosed in WO2010086179 for defining the position at which overflow occurs and the differential stability between two alignment lines. The concept is further developed in PCT/EP2012/054053 for creating a routing mechanism in a microfluidic circuit. As the alignment lines guide the liquid air interface, one may see why such structures are referred to as phaseguides.

Stable pinning structures are of utmost importance for shaping the boundary of a liquid or as stable passive valves. In US2004/0241051A1 there is mention of so-called "pre-shooter stops" that "can inhibit undesired edge flows through a device, i.e. where an introduced fluid flows through the device more quickly along the flow channel edges than the middle regions of the flow channel". Though not explained in detail, it may well be that these pre-shooter stops have a stabilizing effect on the terraces that are introduced in the device for homogeneous filling, although the relation between the terrace and the pre-shooter stop structure is not mentioned or disclosed.

In any case, the structure in US 2004/0241051 A1 does not solve the problem of creating a stable fluid boundary that is meant to shape the fluid profile with an intention of maintaining the fluid in that position. Furthermore, there are no concrete indications in the art of the use of passive stop structures in reference to angles along the barrier or stretch barriers. In fact these barriers are exclusively patterned orthogonal to the wall. In Vulto et al, A microfluidic approach for high efficiency extraction of low molecular weight RNA, Lab Chip 10 (5), 610-616 and in WO 2010/086179, confining phaseguides are used for liquid shaping that are patterned as lines that subtend straight angles with the associated volume wall. It may well be expected that the phaseguides disclosed herein act as capillary pressure barriers, but the stability thereof is limited as the angles with sidewall are never larger than 90° or somewhere along the phaseguide a deliberate location of weakness is included in the form of a sharp V-bend or branching structure in order to determine the position of overflow and/or the stability of the phaseguide.

The capillary pressure barrier according to (a) does not comprise an engineered deliberate weakness along the capillary pressure barrier that reduces the stability of the capillary pressure barrier. Such an engineered deliberate weakness in pinning ability will create a selective location where a fluid meniscus is likely to overflow the barrier.

Figure 5:
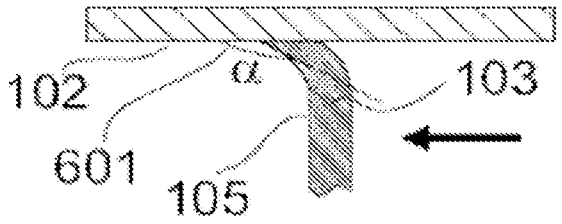
FIGS. 5 to 8 illustrate in horizontally sectioned view various embodiments to achieve a interface angle between the capillary pressure barrier and the wall that is larger than 90°.

Typically, such weakness may be provided by a sharp V-shaped bend in the capillary barrier or a branch along the capillary pressure barrier that reduces the stability of the capillary pressure barrier, as for instance those set out in van EP-A1-2213364, e.g. in FIG. 5 therein.

The term "wall" herein refers to any inner surface facing fluid of the microfluidic channel, including side walls, or a top or bottom substrate.

The term "routing" means selectively directing a fluid throughout a circuit of microfluidic channels.

Referring to FIG. 5 there is shown a stable phaseguide-wall interface that is created by introducing a bend towards the wall 102 in the downstream side (as defined herein) of the phaseguide. This gives rise to a large downstream angle $\alpha$ 601. A practical way to construct the FIG. 5 apparatus is to make the barrier bend according to a certain minimal radius, but preferably this radius is as large as possible.

Throughout the Figures of this document, if not mentioned otherwise, the arrow 154 depicts the direction from upstream to downstream as of importance to the particular capillary pressure barrier under discussion.

Unless mentioned otherwise the capillary pressure barrier in this document is considered present on the in-use bottom substrate of the apparatus. Clearly, this need not necessarily to be so, as the capillary pressure barrier may be present also on the in-use top substrate and even one of the side walls. In more general terminology the substrate on which the capillary pressure barrier is present is referred to as barrier substrate and the substrate facing the substrate on which the capillary pressure barrier is present as the counter substrate.

FIG. 5 thus illustrates a construction in which a stable capillary pressure barrier subtends an angle with a wall of the volume that on the downstream side of the stable capillary pressure barrier is greater than 90°.

Figure 6:
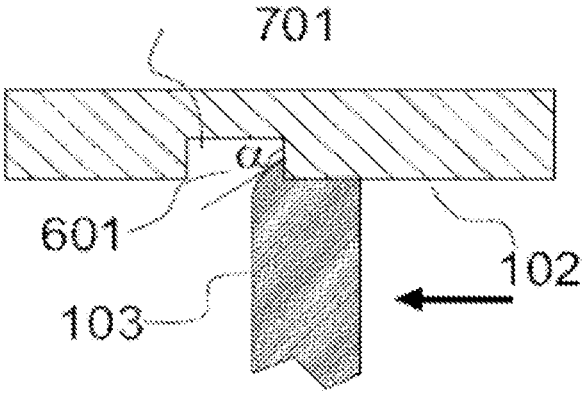

If a forward bend is not desired, an inlet 701 into the wall can be created and the phaseguide can be bent backwards (as referred to the downstream direction as defined) as is shown in FIG. 6, or an existing side channel can be used to create the same effect. Thus the embodiment of FIG. 6 non-limitingly exemplifies an arrangement, in accordance with the invention, in which the stable capillary pressure barrier is defined by or includes a recess or groove defined in the material of a wall of the volume.

Figure 7:
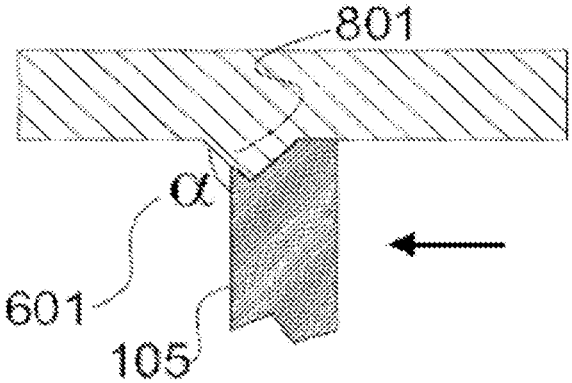
Figure 8:
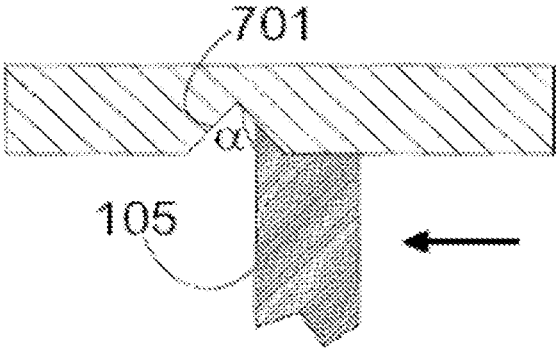

A more practical approach to creating a stable phaseguide-wall interface is by having the phaseguide terminate in a large angle $\alpha$ at the wall. This can be done for example by tilting the edge of the phaseguide, by tilting the wall, by creating a wall intrusion (protuberance) 801 extending into the volume that has a tilted side (FIG. 7), or by creating a wall inlet with a tilted side 701 as shown in FIG. 8. In FIG. 8, the tilt of the wall of the volume is shown in the manner of a notch that recedes away from the main part of the volume. Other ways of creating a tilt in the material of the wall of the volume however lie within the scope of the invention.

Furthermore, other ways of creating the large angle than the recesses, protuberances and tilts described are believed to be possible within the scope of the invention.

The advantage of the approaches set out herein is a practical one: typically, in use in a microfluidics application, the capillary pressure barriers need to be aligned with a wall of a volume in e.g. a multi-layer photolithography process, a milling process, a dispensing process or similar. Using the aforementioned approaches one can allow for a larger alignment inaccuracy without hampering the functionality of the capillary pressure barrier, as the angle remains the same even in the case of a large shift in the capillary pressure barrier position relative to the wall.

The present invention also pertains to an apparatus for controlling the shape and/or position of a moveable fluid-fluid meniscus, the apparatus comprising a volume for containing and directing fluid, the filling direction being a downstream direction, including the meniscus and the volume having at least a first structure defining a capillary pressure barrier along which the meniscus tends to align, the capillary pressure barrier and the meniscus defining a boundary in the volume between at least two sub-volumes, wherein the capillary pressure is stabilized by providing a stretching barrier at a distance less than the maximum stretching distance of the fluid-fluid meniscus upon alignment along the capillary pressure barrier in the absence of the stretching barrier, the stretching barrier being shaped such that at least one directional component is orthogonal to the capillary pressure barrier.

The term "orthogonal" herein refers to at least one component of the stretching barrier being provided at a wall or surface of the volume in a direction that is orthogonal to the capillary pressure barrier. In a typical example where the capillary pressure barrier is present on a bottom substrate, the orthogonal component of the stretching barrier means that its boundary shape can be dissected in at least one component that is perpendicular to the substrate on which the capillary pressure barrier is present. For example if the capillary pressure barrier is patterned on a substrate in a plane that stretches in x and y direction, than the plane is fully defined by it z-coordinate only. The stretching barrier is defined at least by an x and/or a y coordinate in order to have an orthogonal component with respect to the capillary pressure barrier boundary line.

The stretching barrier may also comprise other components which are not orthogonal to the capillary pressure barrier. This is of less importance as long as there is a component perpendicular to the substrate.

For the avoidance of doubt, a capillary pressure barrier may have a non-rectilinear shape, while still an orthogonal component can be found of the stretching barrier with respect to the capillary pressure barrier.

The stretching barrier is typically located on a plane with which the capillary pressure barrier intersects, i.e. a wall when the capillary pressure barrier is present on the bottom substrate. In the case of a non-planar microfluidic channel geometry, the orthogonal component may be defined as being a component that is orthogonally spaced towards a reference vector defined by the first derivative (direction) of the capillary pressure barrier line at the intersection with the wall. Without wishing to be bound to any particular theory, it is believed that a fluid/fluid meniscus will pin to the capillary pressure barrier, and in the process of stretching aligns at least in part to the stretching barrier, thereby forcing the meniscus to take on an energetically less beneficial shape and requiring increased pressure as to breach the capillary pressure barrier as would have been the case when the stretching barrier were not present and the meniscus could fully stretch. This principle may advantageously be applied in any shape of a microfluidic channel.

FIG. 2 describes the stretching distance of a single fluid-fluid meniscus. FIG. 3 shows a top view of the meniscus, while FIG. 2 shows a cross-section normal to the pinning barrier and passing through the centre of the pinning barrier.

The maximum stretching distance of the liquid-air meniscus can be approximated by the formula, assuming that the mid-point of the contact line stays pinned at the edge of the phaseguide at the onset of overflow:

$$d_s = g\left(\frac{\cos\theta_2 - \sin\theta_1}{\cos\theta_1 - \sin\theta_2}\right) \quad \text{(II)}$$

wherein g represents the gap between the substrate on which the pinning barrier is present and the counter substrate, $\theta_1$ and $\theta_2$ represent the contact angles with the counter substrate and the pinning barrier materials respectively. Once the capillary pressure barrier is patterned close to a stretching barrier, e.g. an acute bending of the channel wall at a distance that is less than its maximum stretching distance, the meniscus cannot fully stretch thus increasing the energy required to burst the capillary pressure barrier.

Figure 9:
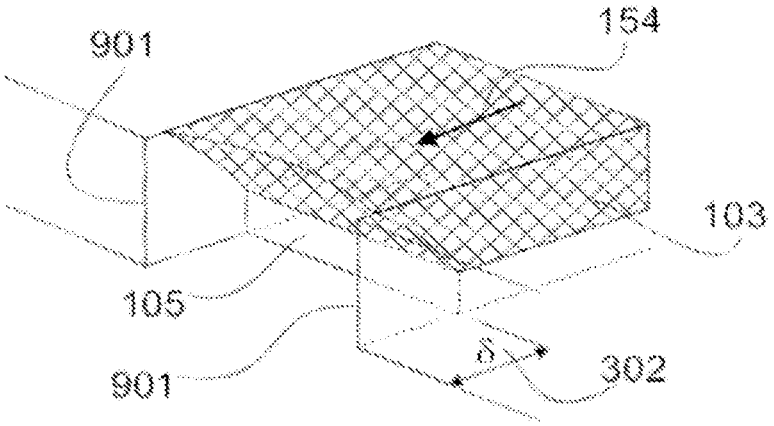
FIGS. 9 and 10 illustrate an embodiment containing both a capillary pressure barrier and two stretching barriers and a meniscus in the condition before and upon reaching the stretching barriers.
Figure 10:
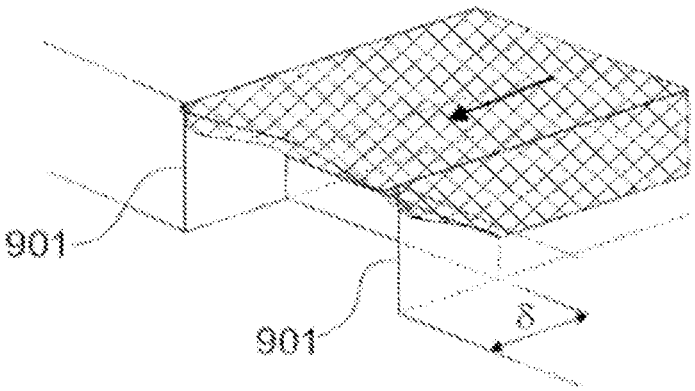

Referring to FIGS. 9 and 10 there is shown a capillary pressure barrier on which a fluid-fluid meniscus is pinned and two stretching barriers. The stretching barriers 901 shown in this figure are represented by an acute bend of the channel structure, as for example is the case for a T-junction. In FIG. 9 the fluid-fluid meniscus is illustrated in the process of stretching, while not having encountered yet the two stretching barriers. In FIG. 10 the fluid-fluid meniscus is illustrated at a point during stretching where the stretching barrier has been reached and partial alignment along the two stretching barriers 901 occur.

In FIGS. 9 and 10 the meniscus is illustrated as being pinned on the edge of the capillary pressure barrier 105. This is done for illustration purposes mainly. In reality, the meniscus boundary may be somewhere on the surface perpendicular to the bottom substrate, while still being in a pinned state.

The meniscus here is illustrated having a concave profile, but is not limited to this geometry. Advantageously, an apparatus according to the invention may also operate in similar manner for a fluid-fluid meniscus of convex profile.

Figure 11:
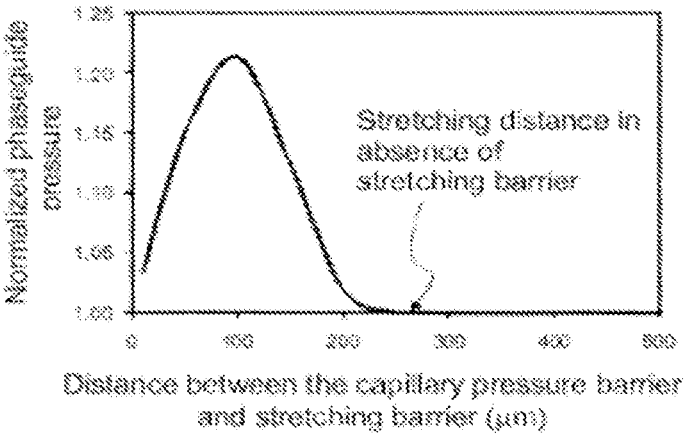
FIG. 11 shows a simulation of the maximum overflow pressure required to breach a capillary pressure barrier as a function of the distance between the capillary pressure barrier and the stretching barrier.

FIG. 11 shows a simulation of the pressure required for breaching a capillary pressure barrier as a function of its distance to a stretching barrier. The simulation was performed for a structure similar to the ones shown in FIGS. 9 and 10. In the simulation is was assumed for the fluid to have a contact angle with the capillary pressure barrier and the side wall material of 70° and for the top substrate material of 20°. Furthermore, a channel height from bottom substrate to top substrate of 120 μm, a height between pinning barrier and top substrate of 90 μm and a channel width of 200 μm was taken. The simulation of FIG. 11 shows that the highest pressure is required for a stretching barrier that is at a distance of about 100 μm to the capillary pressure barrier. Without wishing to be bound to any kind of particular theory, we observe that this distance is roughly half of the theoretical stretching distance in the absence of the stretching barrier as calculated by equation (II).

Figure 12:
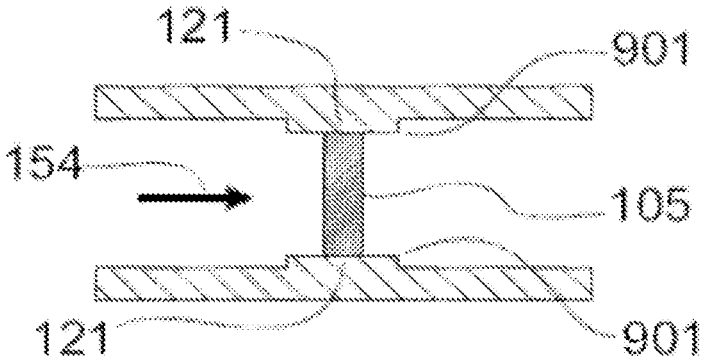
FIGS. 12 to 14 illustrate in horizontally sectioned view various embodiments to achieve a stretching barrier within stretching distance of a capillary pressure barrier.

FIG. 12 shows an alternative possible embodiment to achieve a stretching barrier in the vicinity of a capillary pressure barrier 105. FIG. 12 shows a top view of a channel having a wall protuberance 121 that, when patterned within stretching distance, creates a stretching barrier 901 for a fluid-fluid meniscus that is present on the capillary pressure barrier. A particularly useful aspect of the embodiment depicted in FIG. 12 is that the capillary pressure barrier is stable in both possible directions of meniscus advancement.

Figure 13:
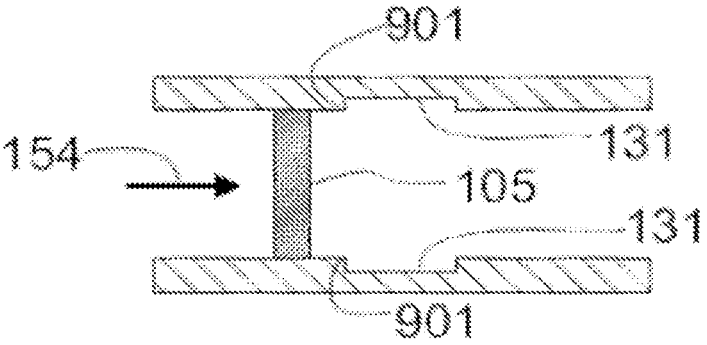

FIG. 13 shows yet another possible embodiment to achieve a stretching barrier in the vicinity of a capillary pressure barrier. In this case a protrusion 131 into the channel wall creates an acute bend that may act as a stretching barrier.

Figure 14:
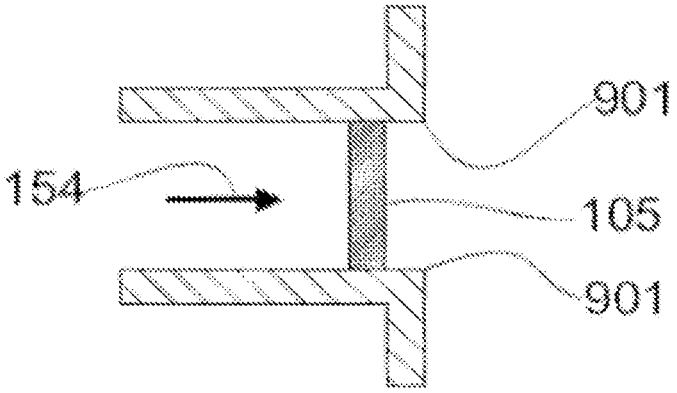

FIG. 14 shows an embodiment as in FIGS. 9 and 10, where the two stretching barriers 901 are created by a bending of the two channel walls.

Figure 15:
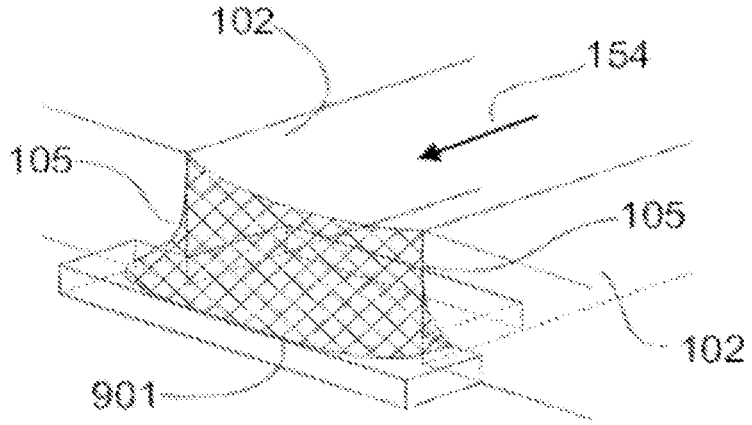
FIG. 15 illustrates an embodiment containing both two capillary pressure barriers and one stretching barrier and a meniscus in the condition upon reaching the stretching barrier.

FIG. 15 shows a different type of particularly stable capillary pressure barrier. The barrier construct depicted in this figure consists of two capillary pressure barriers 105, and one stretching barrier 901. In this case the capillary pressure barriers are present on the side walls 102 of the channel and have the form of an acute bends of the channel wall. The stretching barrier 901 in this example is patterned as a protrusion of the bottom substrate into the volume.

The example of FIG. 15 requires two capillary pressure barriers, while the examples of FIGS. 9, 10, 12, 13 and 14 require two stretching barriers. Clearly, the absence of one of the stretching barriers in the examples of FIGS. 9 to 14 or the absence of one of the two capillary pressure barriers in the example of FIG. 15 still yields a pressure barrier construct that is of higher stability than the capillary pressure barrier without the stretching barrier and is therefore part of the invention.

A person skilled in the art will understand that one of the stretching barriers in the examples of FIGS. 9 to 14 may be absent and instead an interface angle between the wall and the capillary pressure barrier may be present that is larger than 90° on the downstream side with respect to meniscus advancement. This will still yield a capillary pressure barrier of particular stability and is therefore part of the invention.

In FIGS. 1, 2, 9, 10, and 15 the capillary pressure barrier is depicted as a pinning barrier in the form of a rim or a bend. The meniscus for these cases reaches a pinned state at the edge or somewhere along the vertically oriented, downstream side wall of the rim. This implementation represents only one example of an embodiment of the invention and is by no means restricted by this. On the contrary, the capillary pressure barrier may also be created as a hydrophobic patch or a less hydrophilic patch in a largely more hydrophilic channel. In this case, however, the fluid-fluid meniscus is pinned or aligned at the upstream side of the patch.

A similar principle applies to the stretching barrier. These barriers are depicted in FIGS. 9, 10, 12, 13, 14 and 15 as bends, protrusions or inlets, but may as well consist of a hydrophobic patch or a less hydrophilic patch in a largely more hydrophilic channel.

A capillary pressure barrier based on the geometry may in some cases be beneficial over hydrophobic or less hydrophilic patches, as from a manufacturer point of view, the pinning barrier can consist of a material that is the same as the material on which the capillary pressure barrier is present. This means that the whole structure can be made from one material only, leading to a potentially cheaper manufacturing process of the apparatus.

In FIGS. 1, 2, 9, 10, and 15 side wall profiles are depicted as perpendicular to the bottom substrate. This is in the art also referred to as straight sidewall profiles. This is only an exemplary embodiment and is by no means a restriction of the invention. On the contrary, side-wall profiles may well have a certain angle that is offset from the 90° angle with respect to the top substrate. For instance, when considering a replication moulding or embossing strategy a release angle is required in order to release the apparatus from a master. This release angle is referred to in the art as draft angle and is typically in the range of 2° to 10° offset from the 90° angle in a direction that facilitates release from the device from its master. In the art and in this document this is referred to as a positive draft angle.

The draft angle does by no means need to be positive. On the contrary, in photolithographic processes, a sidewall might well have an overhanging profile, referred to as a negative draft. Typically negative photoresists have negative draft angles. Examples of such negative photoresists are SU-8, the dry film photoresist Ordyl SY series (comprising the series SY300, SY550 and SY120), as well as the TMMF and TMMR photoresists and similar epoxy or acrylic based negative fotoresists. The aforementioned photoresists are permanent photoresists and can therefore be used to create channel structures as well as capillary pressure barriers and stretching barriers. Not in all cases the above mentioned photoresists yield a negative draft angle. It may well be possible to achieve a positive draft angle when processing them in a certain manner.

Figure 16:
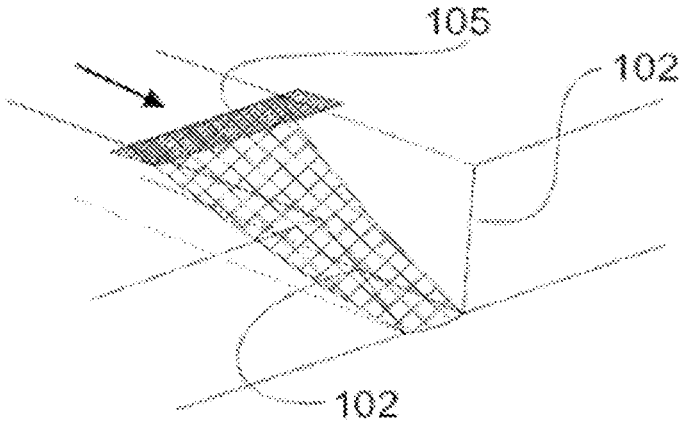
FIGS. 16 and 17 illustrate an embodiment containing both a capillary pressure barrier and two stretching barriers and a meniscus in the condition before and upon reaching the stretching barriers in a channel configuration with tapered walls.

FIG. 16 shows an example of a possible embodiment in which the capillary pressure barrier 105 consists of a patch that may be either hydrophobic or less hydrophilic in comparison the surrounding channel material. The patch in this example is patterned on the top-side of the channel. In this example the sidewalls 102 of the channel structure furthermore have a positive draft angle with respect to the bottom-side of the channel structure. Nonetheless, its positive draft angle, the embodiment in FIGS. 16 and 17 may well yield a functional capillary pressure barrier of particular stability.

Figure 17:
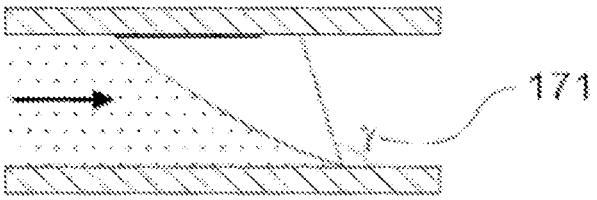

In the embodiment of FIGS. 16 and 17, preferably the stretching barrier, in this example, has actual barrier capacity. This barrier capacity is amongst others determined by the angle between the barrier line and the counter substrate (here bottom substrate), as well as the various contact angles of the materials involved. In order to act as a barrier, the angle depicted as γ 171 in FIG. 17, needs to be larger than a critical angle, γ, that is by approximation given by the Concus-Finn theorem (III):

$$\gamma > 180° - \theta_1 - \theta_2 \quad \text{(III)}$$

where $\theta_1$ and $\theta_2$ are the contact angles with the stretching barrier material and the counter substrate material respectively.

Figure 18:
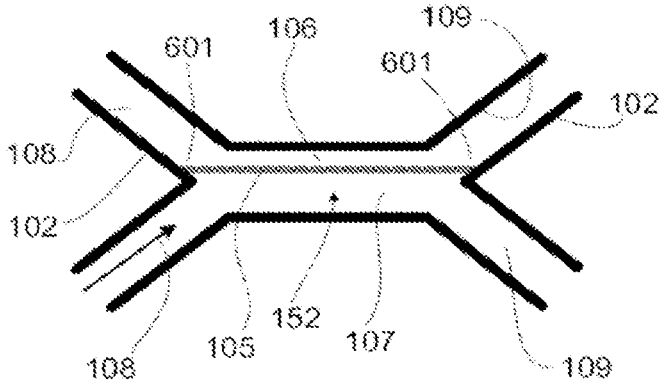
FIGS. 18 and 19 illustrate in horizontally sectioned view two embodiments of apparatus in accordance with the invention.

Examples of the use of stable capillary pressure barriers arise in the patterning of gels and the lamination of liquids next to each other. A preferred embodiment for achieving this is shown in FIG. 18. The figure shows two sub-volumes that are respectively downstream 106 and upstream 107 with respect to the filling direction 154. The volumes are in the form of lanes that are separated inside a volume 152 by a phaseguide 105 that intersects a wall 102 of the volume at an angle 601 that is greater than 90° on the downstream side of the phaseguide. Each lane furthermore has an inlet 108 and outlet 109, one of which in the embodiment described is optional. The first lane 107 may be filled with a gel that is intended to crosslink or react with another substance or be acted on by another substance in any of a range of ways that will be familiar to persons skilled in the art of microfluidics. After gelation the second lane 106 can be filled with another gel or a fluid.

This geometry has the advantage that exchange of molecules between the two lanes happens primarily by diffusion or interstitial flow through the gel. Also, fluid in one lane can be in motion, while the other lane may if desired remain static.

Practical applications of such a structure may include a culture device in which cells are suspended in a gel and are perfused with an adjacent nutrient flow.

Figure 19:
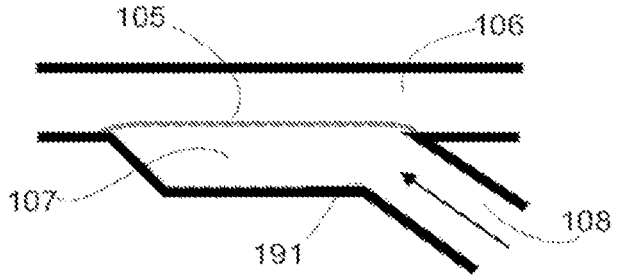
Figure 20:
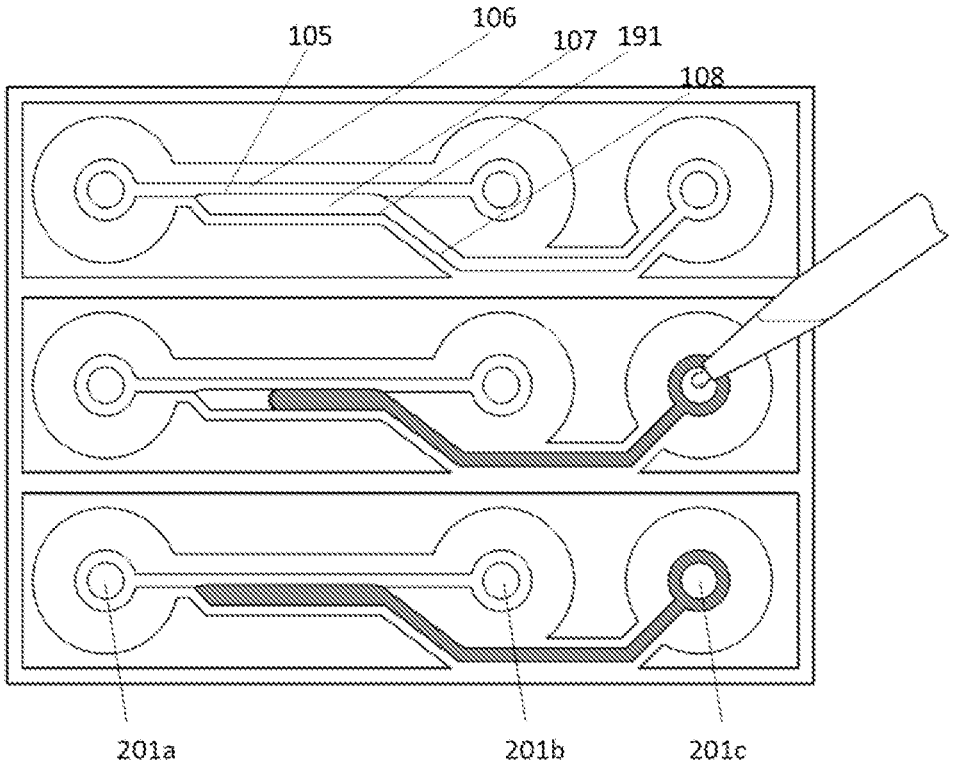
FIG. 20 shows a sequence of experimental images demonstrating operation of one embodiment of the apparatus in accordance with the invention.

A similar geometry is shown in FIG. 19 in which only one inlet 108 is connected to the first volume 107 and the outlet 109 of FIG. 18 is omitted. FIG. 20 shows a sequence of images demonstrating the filling of volume 107 with a fluid. This structure is particularly useful for patterning a gel, possibly containing cells or other substances, in volume 107. After gelation of the gel, the downstream volume 106 may be used for adding a second fluid. This second fluid may for instance contain nutrients for the cells in volume 107, but also a challenge compound, such as a certain medicine, or toxant. The fluid in volume 106 may be flowing as well as being static. The structure of FIGS. 19 and 20 is a specifically important implementation form of the invention, as the curved capillary pressure barrier of particular stability 105 allows patterning of the gel using conventional dispensing tools such as for instance a pipette. Were the capillary pressure barrier not of particular stability, the gel in volume 107 should be dispensed with extreme care in order to prevent breaching of the barrier and subsequent wetting of the downstream volume 106. The large interface angle between the capillary pressure barrier and the wall, decreases the risk of breaching the capillary pressure barrier and therefore makes the apparatus depicted in FIGS. 19 and 20 much more robust to use. In the embodiment of FIGS. 19 and 20, the volume 107 is addressed through a channel that contains a bend 191, while the second volume 106 is a straight channel. This is done to have the three interface holes 201*a-c* in FIG. 20 on one line. However, it may be beneficial to pattern the first fluid in a straight channel, while having the second volume making one or more bends, while still facilitating the three access holes to be located in a straight line from one another.

Figure 21:
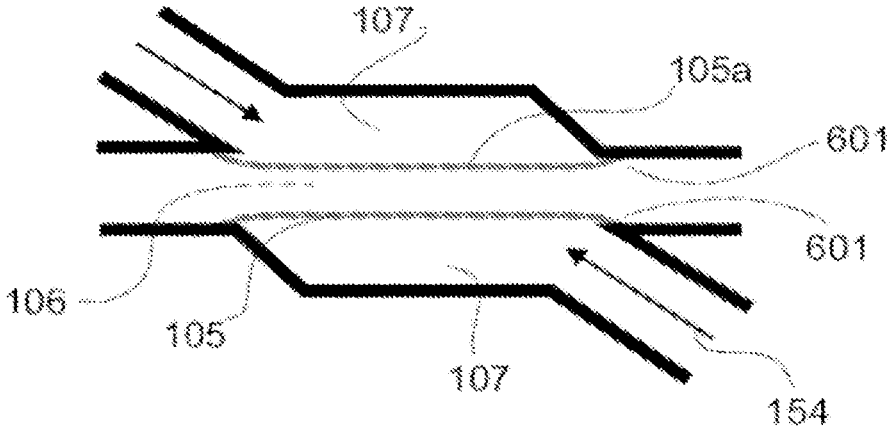
FIG. 21 illustrates in horizontally sectioned view an embodiment of apparatus in accordance with the invention.
Figure 22:
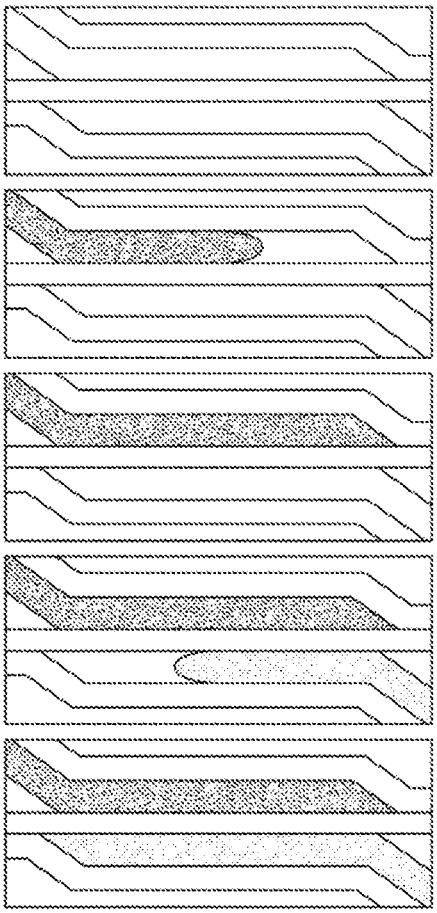
FIG. 22 shows a sequence of experimental images demonstrating operation of one embodiment of the apparatus in accordance with the invention.

FIGS. 21 and 22 shows yet another embodiment and a sequence of experimentally obtained images demonstrating its operation, respectively. A third lane 107*a* is added. Also the second 106 and third 107*a* lanes are separated by a curved capillary pressure barrier 105*a* with stable interface angles between capillary pressure barrier and the wall (i.e. angles greater than) 90° facing the central lane. Each lane 106, 107, 107*a* has an inlet. At least one of the three lanes has an outlet. In the embodiments shown in FIGS. 21 and 22, two respective fluids may be introduced in volumes 107 and 107*a* and pinned respectively on the capillary pressure barriers of particular stability 105 and 105*a*. This geometry is particularly useful when patterning two gels containing substances that are meant or expected to interact with one another. Such substances may be, but are not limited to cells, bacteria, or molecular compounds. Upon gelation the middle lane could be used for inserting a third fluid. For instance the two upstream volumes could contain a gel containing a certain biological material, e.g. a cell type, while the middle lane contains a fluid that is present either in static form i.e. still standing or dynamic, i.e. actively flowing. The embodiment shown in FIGS. 21 and 22 are of particular use for studying interaction between cells or tissues that are separated by a fluid.

In the FIGS. 21 and 22 the two upstream volumes 107 and 107*a* are facing each other. This does not necessarily need to be the case. The volumes may well be also shifted from each other. This may be particularly beneficial if cellular interaction may be studied and excreted compounds are carried by a fluid injected in the central lane towards the second volume in order to study interaction with the species, cells or molecules present in the second gel.

In the FIGS. 21 and 22, the downstream side of the two curved capillary pressure barriers 105 and 105*a* with the large interface angles 601 between the wall and the capillary pressure barrier is facing towards the central lane. This determines the filling sequence as in the example of FIGS. 21 an 22 the volumes 107 and 107*a* are to be filled first in order to make use of the particular stability of the capillary pressure barrier. Clearly, the design of the embodiment could be modified such that the stable side of the capillary pressure barrier is inverted and the central lane is to be filled first.

Figure 23:
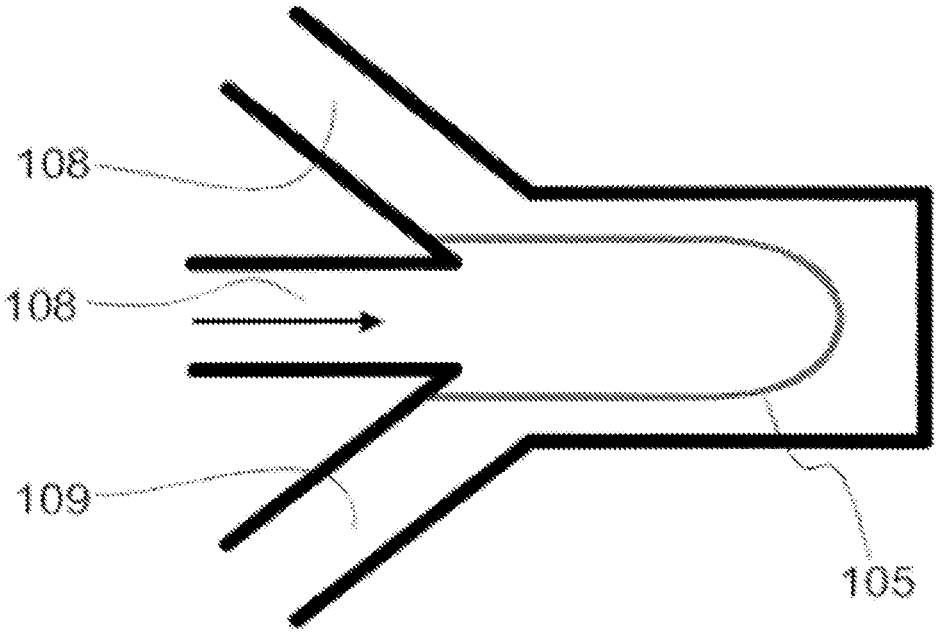
FIGS. 23 and 24 illustrate in horizontally sectioned view an embodiment of apparatus in accordance with the invention.

FIG. 23 shows yet another embodiment that can be used for similar purposes. In FIG. 23 two sub-volumes are defined by an approximately n-shaped phaseguide 105. Three inlet and/or outlet conduits 108, 109 may connect one or more ends of the sub-volumes to the exterior of the volume illustrated.

In any of the FIGS. 18, 19, 21 and 23 almost any number of further sub-volumes, which may or may not be shaped as lanes as illustrated, can be added as required by the application. Furthermore, the lengths, widths and shapes of the individual bodies of fluids that arise on filling of the sub-volumes can also be adapted to virtually any desired geometry.

The capillary pressure barriers in FIGS. 18, 19, 21 and 23 are all patterned, i.e. defined, as "patterning" represents a recognised term for a skilled reader in the capillary pressure barrier or more specifically phaseguide design art, to include a stable wall angle that is larger than 90°. In FIGS. 18 and 23 this angle is achieved by including a tilt or skewing of a channel wall or part thereof relative to the material of the wall in the vicinity of the tilt. In FIGS. 19 and 21 a bend (i.e. curve) of the capillary pressure barrier towards the wall results in a large downstream angle.

However, any of the geometries of FIGS. 5, 6, 7, 8, 12, 13 and 14 can be applied in the arrangements of FIGS. 18, 19, 21 and 23. Also any combination of the arrangements depicted in the FIGS. 5, 6, 7, 8, 12, 13 and 14 may be used to the end of ultimately having a capillary pressure barrier of particular stability.

Figure 24:
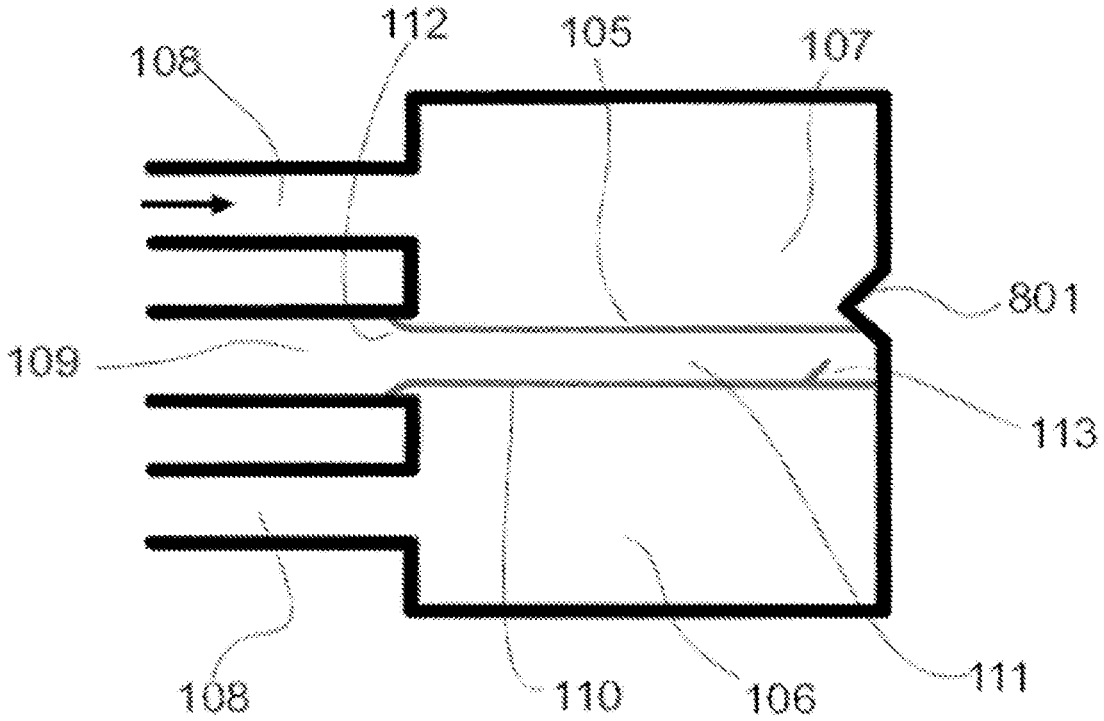

In FIG. 24 a typical geometry is shown that can be used to laminate two liquids one next to the other in a predetermined shape distribution. The geometry contains two inlets 108 and one outlet or vent 109. The stable capillary pressure barrier (phaseguide) 105 is used to stably confine a first liquid in a first sub-volume 107 forming part of the chamber or volume.

A second liquid may be inserted to fill up a second part or sub-volume 106 of the chamber. This step may be followed by overflow of a second capillary pressure barrier 110, and then connecting together of the two liquids and filling up of the space 111 existing between the two capillary pressure barriers 105, 110.

The stable capillary pressure barrier 105 in FIG. 24 has stable interface angles between the capillary pressure barrier and the wall that is greater than 90°. One stable wall angle of the first capillary pressure barrier 105 is realized by a wedge shaped protrusion 801 of the wall into the chamber, and the second is realized by a bend of the capillary pressure barrier 112 directed into the outlet channel. This variety of ways of creating the capillary pressure barrier of particular stability referred to is shown purely to illustrate some of the many possibilities lying within the scope of the invention. It is equally possible to employ two similar or identical means of creating a capillary pressure barrier of particular stability, as defined herein, in one and the same embodiment of the invention.

In other words, the stable interface angle between the capillary pressure barrier and the wall may be realized with any of the above mentioned geometries or combinations thereof.

The second capillary pressure barrier is preferably designed to be flowed over by liquid in a controlled manner by the inclusion of a location 113 of deliberate weakness 113 as extensively described in WO2010/086179 and PCT/EP2012/054053. In this context "weakness" refers to the ease or difficulty with which liquid may be caused to flow over the capillary pressure barrier.

Figure 25:
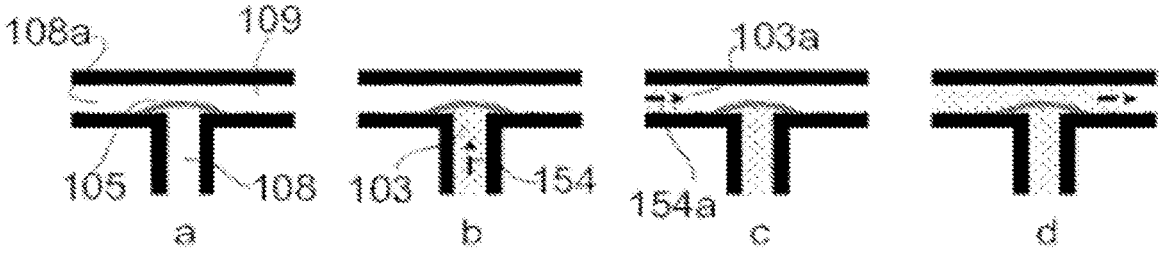
FIG. 25 shows a sequence of images demonstrating a filling operation of one embodiment in accordance with the invention.

Other examples of the use of stable capillary pressure barriers arise in the filling and emptying of complex networks of channels and chambers. An exemplary embodiment for achieving this is shown in FIG. 25. Here a first upstream channel 108 is joined with a second upstream channel 108*a* and a downstream channel 109 in a typical T-junction configuration.

The first upstream channel is spanned by a capillary pressure barrier of particular stability 105. Upon filling the first upstream channel 108 with a first fluid 103, the meniscus of which becomes pinned on the capillary pressure barrier 105. Upon filling the second upstream channel 108*a* with a second fluid 103*a*, the two menisci touch, whereby the two menisci join into one meniscus and the pinned state of the first fluid meniscus is relieved. The joined meniscus is then advancing further in downstream direction.

Figure 26:
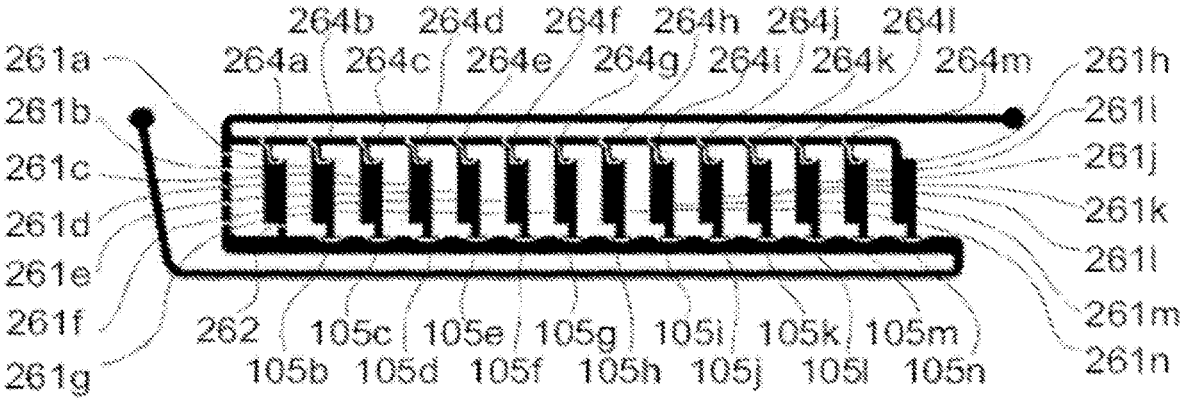
FIG. 26 illustrates in horizontally sectioned view an embodiment of apparatus in accordance with the invention.

FIG. 26 shows a 14 chamber array. The structure contains 13 chambers 261*b-n* that are spanned by a capillary pressure barrier of particular stability 105*b-n*, similar to the embodiment depicted in FIG. 25. The first chamber 261*a* is spanned by a capillary pressure barrier that is of no particular stability 262 as can be derived from the capillary pressure barrier having interface angles with the wall of 90°.

The channel network contains another channel 263 comprising a range of capillary pressure barriers. Neither this channel, nor its barriers are considered in this example. The channel network also contains upstream capillary pressure barriers 264*a-m* with respect to the chambers. These capillary pressure barriers are of no particular stability and are meant to assure a sequential filling of the chambers.

Figure 27:
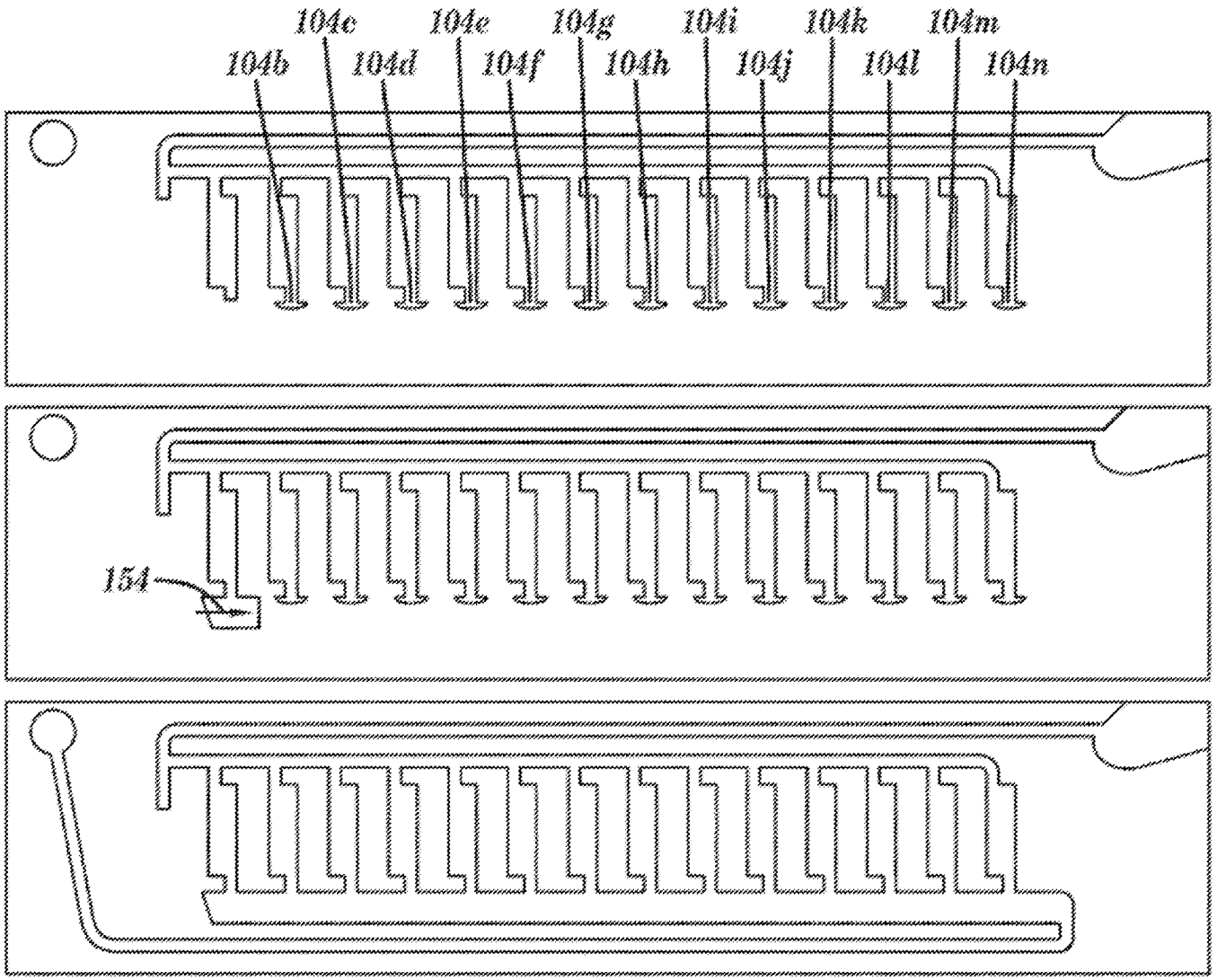
FIG. 27 shows a sequence of experimental images demonstrating operation of one embodiment of the apparatus in accordance with the invention.

FIG. 27 shows a sequence of experimentally obtained pictures depicting the filling process of the 14 chamber array of FIG. 26. Upon filling all chambers 261*a-n* with fluid, the capillary pressure barrier of no particular stability 262 is breached and the advancing meniscus joins sequentially with menisci 104*b-n* that are pinned on the stable capillary pressure barriers 105*b-n* that are located downstream from the capillary pressure barrier of no particular stability.

The capillary pressure barriers of particular stability 105*b-n* in FIGS. 25 and 26 include a stable wall angle that is larger than 90°. It is clear that a similar functionality is obtained by including a capillary pressure barrier of particular stability with the help of a stretching barrier. In fact, any of the geometries of FIGS. 5, 6, 7, 8, 12, 13 and 14 can be applied to obtain the result of FIGS. 25 and 26. Also any combination of the arrangements depicted in the FIGS. 5, 6, 7, 8, 12, 13 and 14 may be used to the end of ultimately having a capillary pressure barrier of particular stability. For instance, one side of a capillary pressure barrier could pertain a large angle with the interfacing wall, while the stretching barrier is provided within stretching distance of an acute bend of the wall. Clearly also a combination of the two principles is particularly preferred, i.e. an alignment barrier-wall interface with large downstream angle and within stretching distance of a stretching barrier having an orthogonal component, such as an acute bend.

The selective overflow of capillary pressure barrier 262 in FIG. 27 with respect to capillary pressure barriers 105 is an example of liquid routing due to differential stability of multiple capillary pressure barriers. The differential stability, i.e. one barrier is more stable than another is here obtained by angle variation. This principle is extensively described in WO2010086179 and PCT/EP2012/054053. The simulation of FIG. 11 shows that variation of barrier stability can also be obtained by variation of the distance between the capillary pressure barrier and the stretching barrier. This enables differential stability that may be used for liquid routing purposes using the capillary pressure barrier/stretching barrier combination with the distance between them as a parameter for barrier stability. Any embodiment in which two or more capillary pressure barriers are present that have different stability respective to one another by a difference of the distance between the capillary pressure barrier and the stretching barrier is part of the invention.

Also any embodiment in which two or more capillary pressure barriers are present that have different stability respective to one another by at least one capillary pressure barrier that is stabilized by a stretching barrier and at least one second capillary pressure barrier that is not stabilized by a stretching barrier is part of the invention.

The use of capillary pressure barriers of particular stability in the filling of complex channel and chamber networks is particularly advantageous, as the filling of such networks typically introduces large pressure differences between the various menisci that are pinned. Large channel lengths lead to large hydrodynamic resistances. In order to apply the required pressure to fill such channels smoothly, while not breaching a particular capillary pressure barrier that is located upstream from that channel, requires the capillary pressure barrier to be of particular stability.

A typical phaseguide is a protrusion of material into the main part of the volume or chamber in which it lies, creating a capillary pressure barrier with respect to two directions of meniscus advancement. However, pinning can also be achieved at the edge of a plateau, in which the capillary pressure barrier then exists with respect to one direction of meniscus advancement. Furthermore, a recess, e.g. a groove, formed in the material can also be used as a pinning geometry.

An advantage of a protrusion into the volume or a groove with respect to a plateau is that the chamber and channel height remain the same (with exception of the location of the capillary pressure barrier itself), throughout the chamber and channel network.

The range of materials that may be used to create such a capillary pressure barrier is very large and includes polymers such as PDMS, polyacrylamide, COC, polystyrene, acrylic materials, epoxic materials, photoresists, silicon, and many others. These materials can be used either monolithically or in combination.

A typical implementation of phaseguides uses a hydrophilic top substrate, i.e. glass and a less hydrophilic pinning barrier, i.e. a polymer such as plastic or a photoresist.

Another capillary pressure barrier could be a line of material that has a lower wettability with respect to the surrounding material. Also in this case the line functions as a capillary pressure barrier, whose stability upon alignment is determined by its wall angle. Such a line may be a hydrophobic material such as Teflon, and also materials that are still in the hydrophilic domain, such as SU-8 photoresist.

Capillary effects are most effective when the distance between the phaseguide and the counter-substrate is small. Typically this distance is smaller than 1 mm, and preferably 500 μm or smaller. Practically, we use distances smaller than 200 μm.

A protrusion barrier functions most effectively as a stable capillary pressure barrier when the angle of the side wall with its counter-substrate (a in FIG. 2) is close to 90°, equal to 90° or even larger than 90°. In practice, when using plastic processes, such as milling or injection moulding, the side wall profile will have a draft angle that renders the angle α smaller than 90°. A typical draft angle for release in injection moulding is between 6° and 8°, leading to a value of a of 84° or 82° respectively. It is important to maintain the draft angle as small as possible (in other words to maintain a as large as possible) for a stable pinning barrier.

A specific practical application of this is the patterning of cells in a gel in a multilane microchamber of the general kind (perhaps including more lanes than those described) as shown in FIGS. 18, 19, 21 and 23. The reactor has inlet channels that finish in a wedge shaped end point that serves to permit selectively filling of a first lane with gel under stable pinning conditions.

A second lane may be used for perfusion of nutrients and transport of metabolites. A third lane can be used for adding a challenge such as a reagent or a protein or other substance that may affect cells in the first lane, for co-culture with additional cell types, or for adding a perfusion flow having a different composition to create a gradient such as a concentration gradient across the gel.

The capillary pressure barriers in this document are mostly drawn as straight lines. This does not need to be so. In fact capillary pressure barriers may have any shape.

The most typical application of this invention is to create a stable interface between an aqueous liquid and air, however the invention also may be used for any fluid-fluid configuration that has a stable meniscus, i.e. the two fluids are immiscible. Examples include any gas-liquid or oil-water interfaces.

The various uses of the apparatus described herein amount to methods of controlling the shape of a moveable fluid-fluid meniscus in apparatus according to the invention as defined or described herein, the method comprising the step of causing the meniscus to align along the stable capillary pressure barrier of the apparatus.

For the case of a gel, the patterning of the gel takes place prior to gelation, i.e. when the gel is a fluid.

The listing or discussion of an apparently prior-published document in this specification should not necessarily be taken as an acknowledgement that the document is part of the state of the art or is common general knowledge.

Advantageous, optional features of the invention are defined in the dependent claims.

Some embodiments of the technology described herein can be defined according to any of the following numbered paragraphs:

1. Apparatus for controlling the shape and/or position of a moveable fluid-fluid meniscus, the apparatus comprising a volume for containing and directing fluid, the filling direction being a downstream direction, including the meniscus and the volume having at least a first structure defining a capillary pressure barrier along which the meniscus tends to align, the capillary pressure barrier and the meniscus defining a boundary in the volume between at least two sub-volumes, wherein (a) the capillary pressure barrier is stabilized by subtending at both ends an angle with a wall of the volume that on the downstream side of the capillary pressure barrier is greater than 90°, while not providing a deliberate fluid alignment weakness along the capillary pressure barrier that reduces the stability of the capillary pressure barrier and/or (b) wherein the capillary pressure is stabilized by providing a stretching barrier at a distance less than the maximum stretching distance of the fluid-fluid meniscus upon alignment along the capillary pressure barrier in the absence of the stretching barrier, (c) the capillary pressure barrier is stabilized by subtending at one end an angle with a wall of the volume that on the downstream side of the capillary pressure barrier is greater than 90°, and at the other end is stabilized by providing a stretching barrier at a distance less than the maximum stretching distance of the fluid-fluid meniscus upon alignment along the capillary pressure barrier in the absence of the stretching barrier;

wherein the stretching barrier is shaped such that at least one directional component is orthogonal to the capillary pressure barrier.

2. Apparatus according to paragraph 1, wherein the volume includes:

(c) at least two fluid inlets whereby at least one of at least two respective fluids may be filled into the sub-volumes; and (d) at least one fluid outlet whereby fluid may be removed from at least one of the sub-volumes, the direction of flow of fluid in a filling direction being a downstream direction.

3. Apparatus according to paragraph 1 or paragraph 2, wherein the capillary pressure barrier is defined by or includes one or more of:

i) a recess or groove defined in the material of a wall of the volume;

ii) a protuberance from a wall of the volume into the volume; and/or iii) a line defined in or on the material of a wall of the volume that is of lower wettability than the material of the the wall adjacent the line.

4. Apparatus according to any one of the preceding paragraphs, wherein the stretching barrier is defined or includes one or more of:

iv) a recess or groove defined in the material of a wall of the volume;

v) a protuberance from a wall of the volume into the volume;

vi) a bend or recess opening into a further channel or reservoir.

vii) a line defined in or on the material of a wall of the volume that is of lower wettability than the material of the wall adjacent the line.

5. Apparatus according to any of the preceding paragraphs wherein at least one end of the capillary pressure barrier has a curved shape in the vicinity of the intersection with a wall of the volume so as to define a radius of at least and preferably at least 10 at the intersection of the capillary pressure barrier with the wall.

6. Apparatus according to any preceding paragraph wherein at least one end of the capillary pressure barrier intersects a wall of the volume and is a straight line shape in the vicinity of the resulting intersection.

7. Apparatus according to any preceding paragraph wherein at least one end of the capillary pressure barrier intersects a wall, of the volume, that defines a portion of the wall that is tilted with respect to the surrounding the wall, that defines a recess in the vicinity of the resulting intersection, and/or that defines a protuberance from the wall into the volume.

8. Apparatus according to any one of paragraphs 3 to 7, wherein the recess is or includes a channel or inlet defined in a wall of the volume.

9. Apparatus according to any one of paragraphs 3 to 8, wherein the protuberance includes a wedge-shaped and/or triangular part.

10. Apparatus according to any one of the paragraphs, wherein the stretching barrier comprises a bending of the wall.

11. Apparatus according to paragraph 10 wherein the bending of the wall bends outwards the channel over an angle of at least 90°.

12. Apparatus according to any one of the preceding paragraphs, wherein the stretching barrier is positioned at a distance relative to the capillary pressure barrier at half or less than half of the stretching distance of the fluid-fluid meniscus in the absence of the stretching barrier.

13. Apparatus according to any one of the preceding paragraphs, wherein the maximum stretching distance, $d_s$, is defined by formula II:

$$d_s = g\left(\frac{\cos\theta_2 - \sin\theta_1}{\cos\theta_1 - \sin\theta_2}\right), \quad \text{(II)}$$

wherein g represents the distance between the first substrate on which the first capillary pressure barrier is provided and the second substrate facing the substrate on which the first capillary pressure barrier is provided;

wherein $\theta_1$ represents the contact angle of the fluid with the substrate facing the first capillary pressure barrier the; and wherein $\theta_2$ represents the contact angle of the fluid with the capillary pressure barrier material.

14. Apparatus according to any one of the preceding paragraphs, wherein the first capillary pressure barrier is provided on the bottom substrate, and wherein at least one stretching barrier is provided on a side wall of the channel.

15. Apparatus according to any one of the preceding paragraphs, wherein the apparatus comprises at least one additional capillary pressure barrier, and wherein the first capillary pressure barrier is part of a routing circuit of fluids through a network of channels.

16. Apparatus according to paragraph 15, wherein the first capillary pressure barrier is stabilized by a stretching barrier at a given first distance from the capillary pressure barrier and wherein a) the at least one additional capillary pressure barrier is stabilized by a stretching barrier at a given second distance from the one additional capillary pressure barrier that is different from the first distance between the first capillary pressure barrier and its stretching barrier, or b) the at least one additional capillary pressure barrier is not stabilized by a stretching barrier 17. Apparatus according to any preceding paragraph, wherein the volume includes at least two fluid inlets and/or outlets defining a generally Y-shaped junction including an apex, and wherein the capillary pressure barrier defines an offset intersection with a wall of the volume at a location that is offset from the apex.

18. Apparatus according to any preceding paragraph, including a hydrophilic top substrate and a less hydrophilic capillary pressure barrier.

19. Apparatus according to paragraph 18, wherein the hydrophilic top substrate is or includes a silicate glass and the less hydrophilic capillary pressure barrier is or includes a polymeric material.

20. Apparatus according to any preceding paragraph, wherein the capillary pressure barrier and/or the stretching barrier subtends an angle with a side wall that is larger than the critical angle as defined by the Concus-Finn theorem.

21. A method of controlling the shape and/or location of a moveable fluid-fluid meniscus in apparatus according to any preceding paragraph, the method comprising the step of causing the meniscus to align along the capillary pressure barriers of particularly high stability of the apparatus.

22. A method according to paragraph 21, further comprising causing the meniscus to also align at least in part with the stretching barrier, thereby creating a doubly aligned meniscus.

23. A method according to paragraph 21 or 22, wherein the meniscus the shape of which is controlled is between a gel and a further fluid, and wherein the step of causing the meniscus to align along the capillary pressure barrier occurs before gelation of the gel occurs.

24. A microfluidic circuit comprising a multitude of microfluidic channels, and further comprising one or more apparatus according to any one of the preceding paragraphs.

25. Use of the apparatus according to any one of paragraphs 1 to 20 or a circuit according to paragraph 24 for the directed routing of fluids.

The invention claimed is:

1. Apparatus for controlling a shape and/or position of a moveable aqueous liquid-air meniscus, the apparatus comprising:

a microfluidic channel having walls for containing and directing fluid; and at least a first capillary pressure barrier which defines a boundary in the microfluidic channel between at least two sub-volumes of the microfluidic channel; the at least two sub-volumes further defined by the walls of the microfluidic channel, wherein the first capillary pressure barrier has first and second sides, and first and second ends with each end having an intersection with a wall of the microfluidic channel, each end defining on the same side of the first capillary pressure barrier an angle at its intersection with the wall of the microfluidic channel that is greater than 90°, wherein the first capillary pressure barrier does not comprise a sharp V-shaped bend in the first capillary pressure barrier and wherein the first capillary pressure barrier does not comprise a branch along the first capillary pressure barrier, wherein the microfluidic channel includes:

at least a first, second, and third access holes, the first access hole accessing a first of the at least two sub-volumes and the second and third access holes accessing a second of the at least two sub-volumes; and wherein the walls of one of the at least two sub-volumes include one or more bends so that the at least first, second, and third access holes are located in a straight line from one another.

2. The apparatus according to claim 1, wherein the walls of the microfluidic channel are formed from a material, and wherein the first capillary pressure barrier is selected from one or more of:

i) a recess or groove defined in the material of a wall of the walls of the microfluidic channel;

ii) a protrusion from a wall of the walls of the microfluidic channel into the microfluidic channel; and/or iii) a line defined in or on the material of a wall of the walls of the microfluidic channel that is of lower wettability than the material of the wall adjacent the line.

3. The apparatus according to claim 1, wherein at least one end of the first capillary pressure barrier has a curved shape with a radius of at least 1 μm at its intersection with the wall of the microfluidic channel.

4. The apparatus according to claim 1, wherein at least one end of the first capillary pressure barrier has a straight section at its intersection with the wall of the microfluidic channel.

5. The apparatus according to claim 1, wherein the wall of the microfluidic channel that is intersected by at least one end of the first capillary pressure barrier further comprises a tilted section, a recess or a protuberance at the intersection.

6. The apparatus according to claim 1, wherein the recess is or includes a channel or inlet defined in a wall of the microfluidic channel.

7. The apparatus according to claim 1, wherein one of the walls of the microfluidic channel is a top substrate wall which is hydrophilic and wherein the first capillary pressure barrier is less hydrophilic than the top substrate wall.

8. The apparatus according to claim 7, wherein the top substrate wall is, or includes, a silicate glass and the first capillary pressure barrier is or includes polymeric material which is less hydrophilic than the silicate glass.

* * * * *